US005133607A

United States Patent [19]

Bonke

[11] Patent Number: 5,133,607

[45] Date of Patent: Jul. 28, 1992

[54] PLASTIC LINER BAG WITH ELASTIC TOP TIE STRIP

[75] Inventor: Douglas D. Bonke, Appleton, Wis.

[73] Assignee: Reynolds Consumer Products Inc., Appleton, Wis.

[21] Appl. No.: 776,032

[22] Filed: Oct. 15, 1991

Related U.S. Application Data

[63] Continuation-in-part of Ser. No. 690,871, Apr. 22, 1991.

[51] Int. Cl.[5] ..... B65D 33/30

[52] U.S. Cl. ..... 383/75; 383/33; 383/72; 220/404

[58] Field of Search ..... 383/33, 43, 71, 72, 383/75; 220/287, 403, 404

[56] References Cited

U.S. PATENT DOCUMENTS

| | | | |
|---|---|---|---|
| 781,821 | 2/1905 | Glenwright . | |
| 2,159,192 | 5/1939 | Werdin | 220/65 |
| 2,654,892 | 10/1953 | Szabo | 4/110 |
| 2,656,769 | 10/1953 | Hultkrans | 93/35 |
| 2,798,107 | 10/1956 | Magid | 154/116 |
| 2,798,523 | 7/1957 | Barrett | 150/11 |
| 2,799,611 | 7/1957 | Dreisbach | 154/118 |
| 3,099,237 | 7/1963 | Currin et al. | 112/262 |
| 3,565,738 | 2/1971 | Kirkpatrick | 161/38 |
| 3,889,872 | 6/1975 | Lin | 229/63 |
| 3,902,541 | 9/1975 | Wardwell | 150/48 |
| 4,338,979 | 7/1982 | Dow | 141/10 |
| 4,509,570 | 4/1985 | Eby et al. | 141/390 |
| 4,747,701 | 5/1988 | Perkins | 383/33 |
| 4,778,283 | 10/1988 | Osborn | 383/71 |
| 4,786,189 | 11/1988 | Broderick et al. | 383/75 |
| 4,792,241 | 12/1988 | Broderick et al. | 383/75 |
| 4,802,582 | 2/1989 | Johnson | 206/390 |
| 4,813,792 | 3/1989 | Belmont eet al. | 383/75 |
| 4,844,248 | 7/1989 | Forberg et al. | 206/390 |
| 4,930,905 | 6/1990 | Sharps, Jr. | 383/75 |
| 4,938,607 | 7/1990 | Kelley | 383/4 |
| 4,953,704 | 9/1990 | Cortese | 206/493 |
| 4,991,978 | 2/1991 | Ostrowski | 383/4 |
| 5,029,371 | 7/1991 | Rosenblood et al. | 24/712.9 |

FOREIGN PATENT DOCUMENTS

| | | | |
|---|---|---|---|
| 1236831 | 6/1960 | France | 383/72 |
| 1271439 | 7/1961 | France | 383/75 |
| 1367590 | 6/1964 | France | 383/72 |
| 1419805 | 10/1965 | France | 220/404 |
| 2604419 | 4/1988 | France | 383/71 |
| 1495236 | 7/1989 | U.S.S.R. . | |

*Primary Examiner*—Stephen Marcus
*Assistant Examiner*—Jes F. Pascua
*Attorney, Agent, or Firm*—Alan T. McDonald

[57] ABSTRACT

A plastic trash bag is disclosed which includes an elastic drawstring. The drawstring may expand to conform to a container over which the bag is placed but does not close the opening of the bag below the circumference at which the opening is formed when retracted.

5 Claims, 2 Drawing Sheets

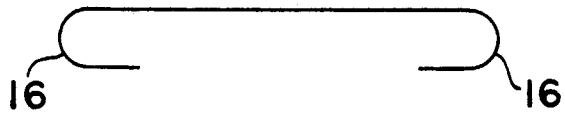
FIG. 4
FIG. 5
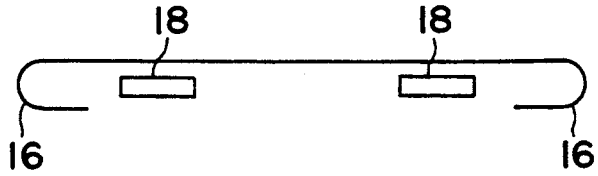
FIG. 6
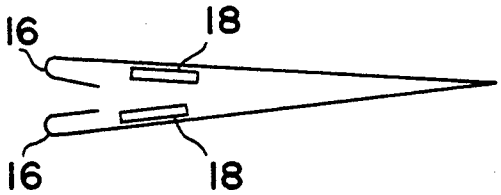
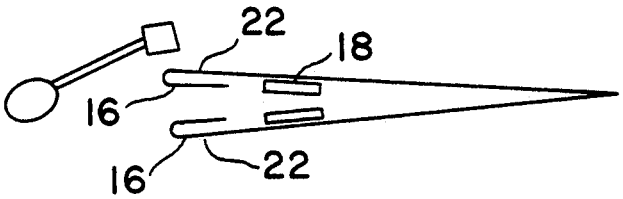
FIG. 7
FIG. 8
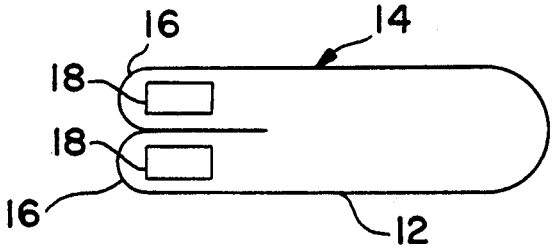
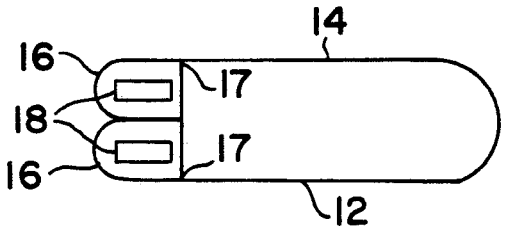
FIG. 9
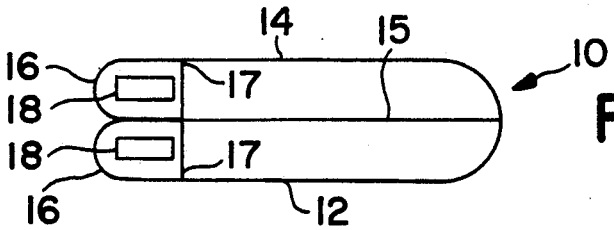
FIG. 10

PLASTIC LINER BAG WITH ELASTIC TOP TIE STRIP

CROSS-REFERENCE TO RELATED APPLICATIONS

This is a continuation-in-part of co-pending U.S. Application Ser. No. 07/690,871, filed Apr. 22, 1991.

FIELD OF THE INVENTION

The present invention relates to plastic bags which are used as liners for waste receptacles, and more particularly to an integral elastic drawstring which is elongated and then relaxed to secure the top of the bag to the receptacle and subsequently used to close the bag when filled.

BACKGROUND OF THE INVENTION

In order to maintain sanitary conditions, plastic bags have been used to line waste receptacles in both institutional and commercial practice. The plastic liner bag prevents waste or other materials from contacting the receptacle, as well as providing a simple and easy way to empty the container.

Because of the large variety of container sizes, it is difficult to secure the bag to the container so that it will not slide down into the receptacle. Merely folding the top of the bag over the sides of the receptacle is not satisfactory, since the materials in the bag tend to pull the bag into the receptacle.

U.S. Pat. No. 4,509,570 describes a plastic bag which has an elastic loop positioned in the hem at the top of-the bag. The elastic loop provides a means to hold the bag at the top of the receptacle as well as to close the bag when it is removed from the receptacle. The elastic loop is in a highly stretched state when the bag is open and closes the top of the bag automatically when removed from the receptacle. It is difficult and expensive to manufacture a bag with the elastic band in a highly stretched state. Further, a bag having the automatic closing feature of this patent can provide a safety hazard to a child who may inadvertently obtain one of the bags and place the bag over his head. A bag having a similar elastic top is found in French Patent No. 1,419,805.

In U.S. Pat. No. 4,747,701 a plastic liner bag is described which has an elastic band partially secured to the open top of the plastic bag. The plastic band is used to overlap the top of a receptacle to hold the bag in place on the receptacle. This band cannot be used as a drawstring to close the top of the bag when it is filled. French Patent No. 1,367,590 also describes a bag having an elastic top which does not act as a drawstring.

U.S. Pat. No. 4,802,582 describes a typical drawstring trash bag. The drawstring of this patent is not elastic.

In U.S. Pat. No. 4,792,241 the drawstring of the bag has a circumference less than that of the bag, but the drawstring is not elastic.

U.S. Pat. No. 4,938,607 utilizes a drawstring in forming a plastic sheet that can be used to produce a container for yard clippings and the like. The outer dimensions of the drawstring is smaller than the outer dimensions of the plastic sheet, but the drawstring is not elastic.

French patent No. 2,604,419 concerns a pouch for food having an elastic cord to fit over the contents of the pouch when eating.

SUMMARY OF THE PRESENT INVENTION

The present invention relates to a plastic liner bag which includes elastic drawstrings that are enclosed in the hems at the top of the plastic bag which can be used to both hold the top of the bag on the top of a receptacle as well as to close the bag when filled. The elastic drawstrings are sealed in the hem provided at the top of the bag in a relaxed state. The top of the bag is notched at each side to expose the ends of the elastic drawstrings on each edge of the bag. The drawstrings are then sealed on the ends to form a closed loop elastic drawstring in the hem which has a circumference that is smaller than the circumference of the bag. As such, the closed loop elastic drawstring can be stretched slightly when the hem is folded over the top edge of a receptacle. The closed loop elastic drawstring then contracts to securely hold the top of the bag in place. Because the closed loop drawstring is formed from the elastic drawstrings when in a relaxed state, in its as-formed condition, as well as when it is released from the receptacle, the closed loop drawstring does not close the opening in the top of the bag to a circumference less than that at which the opening is formed.

The closed loop elastic drawstring is also used as a tie strip to close the bag when it is removed from the receptacle. The drawstring thus advantageously provides both a holding force for maintaining the bag in the receptacle and a tie string for closing the bag when removed from the receptacle.

One of the primary advantages of the present invention is the use of an elastic drawstring to both support the top of a plastic bag at the top of a receptacle as well as close the top of the bag when filled.

Another advantage of the present invention is the ability to manufacture a plastic bag in a standard bag forming machine with an elastic drawstring that has a circumference smaller than the circumference of the top of the bag.

A further advantage of the invention is the use of a drawstring in the form of a continuous loop which is not welded to the hem and thereby allows for easier closure of the bag and use of the elastic drawstring to enclose the top of the receptacle.

A still further advantage of the invention is the use of an elastic drawstring that is sealed within the hems of the bag in a relaxed state. As such, the closed loop elastic drawstring does not close the opening in the top of the bag to a circumference smaller to that at which the opening is formed.

Other principal features and advantages of the invention will become apparent to those skilled in the art upon review of the following drawings, the detailed description and the appended claims.

BRIEF DESCRIPTION OF THE DRAWINGS

The plastic liner bag of the present invention will be more fully described with reference to the drawings in which:

FIG. 4 is a cross-sectional view of the plastic film in continuous motion with a hem forming on each side;

FIG. 5 is a cross-sectional view of the film after a two inch tape has been slit into two one inch strips and placed near the hems, which tape strips are carried with the web as it moves through the bag making machine;

FIG. 6 is a cross-sectional view of the folded web;

FIG. 7 is a cross-sectional view of the notches formed on each end of the hem, after the web has been converted to intermittent motion after passing through a web drive and dancer system;

FIG. 8 is a cross-sectional view of the tape strips after they have been guided into the hems and sealed on each end in close proximity to the inner edge of the notches near the hems;

FIG. 9 is a cross-sectional view of the film with the hems sealed; and

FIG. 10 is a cross-sectional view of the film with the sides welded to form the bag.

Figure 1:
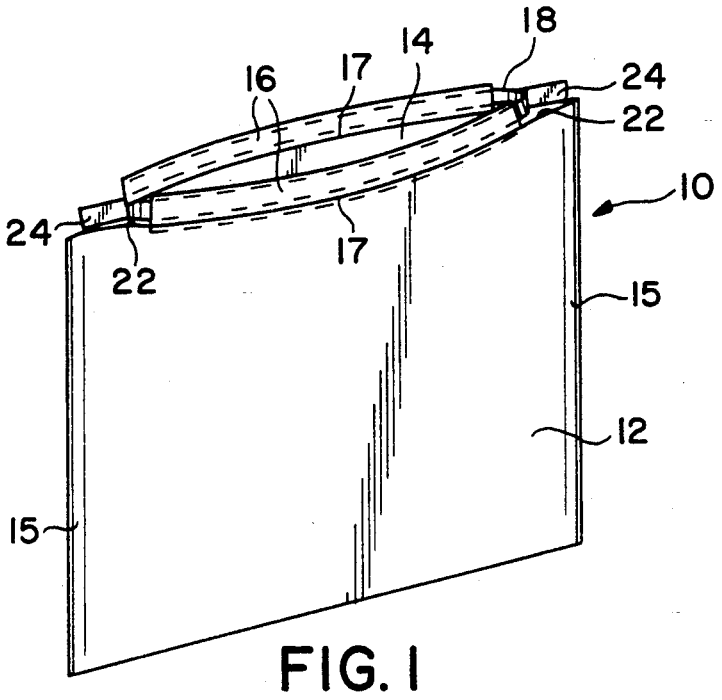
FIG. 1 is a perspective view of the plastic liner bag according to the present invention.
Figure 3:
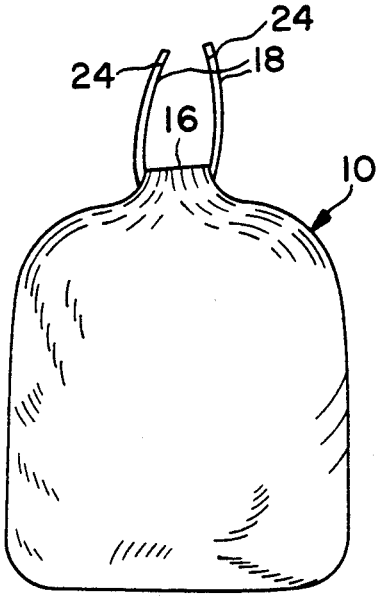
FIG. 3 is a front view of the plastic bag with the closed loop elastic drawstring used as a tie strip.
Figure 2:
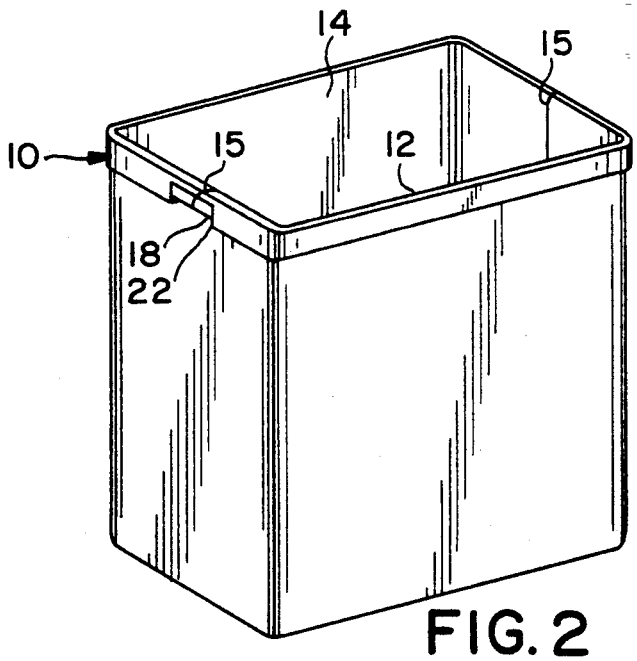
FIG. 2 is a perspective view of the plastic liner bag mounted in a container with the hem turned outward around the top of the container.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purposes of description and should not be regarded as limiting.

DETAILED DESCRIPTION OF THE PREFERRED EMBODIMENTS

Referring to the drawings, a plastic liner bag 10 is shown which is suitable for use as a receptacle liner. The bag 10 is made from a film of thermoplastic material. In the preferred embodiment, a polyethylene film is used; however, a wide variety of other plastic films may be used, such as ethylene and polyvinyl acetate copolymers. The thickness of the film will vary depending on the particular thermoplastic material selected and the durability required of the specific application. The film used in the bag will preferably be between 0.0005 and 0.0015 inches thick. The film has poor elastic properties. Typically, the film exhibits elastic recovery values from 60% to 30% when elongated from 50% to 300%. The bag 10 generally includes a front 12 and a back 14 which are formed from a single sheet of material which is folded at the bottom and sealed at the edges 15. The top is provided with hems 16 which are folded over and heat sealed to the inside of the front and back sheets along lines 17.

In accordance with the present invention, a closed loop elastic drawstring 18 is provided in the hems 16 which can be used both to retain the top of the bag at the top of a receptacle as well as a drawstring for closing the bag when filled.

The closed loop elastic drawstring 18 can be formed of a thermoplastic rubber or an elastomeric polyolefin material. A preferred material for the closed loop elastic drawstring is a film grade KRATON® thermoplastic rubber produced by Shell Chemical Company blended with a polyolefin, such as linear low density polyethylene, to reduce material costs. The blend may be, for example, 57% thermoplastic rubber, 40% linear low density polyethylene and 3% pigment. Typically, a KRATON film grade thermoplastic rubber will exhibit excellent elastic recovery values ranging from 95% to 90% when elongated from 50% to 500%. The elastic drawstring described in the present invention exhibits sufficient elastic recovery properties to elongate and secure the top of the bag to a container. Typically, the KRATON and polyethylene blended drawstring exhibits elastic recovery values from 85% to 55% when elongated from 50% to 500%. This is opposed to the non-elastic high density polyethylene commonly found as drawstring material in drawstring bags which typically have very poor elastic recovery properties ranging from 50% to 25% when elongated from 20% to 200%. A further dramatic difference between the elastic drawstring described in this invention and typical high density polyethylene drawstrings is the stiffness of the material. Typically, a tensile 1% secant modulus test is conducted to determine the stiffness of a film. By definition, the 1% secant modulus is the slope of a stress-strain curve to a 1% strain or extension. Typically, the KRATON and polyethylene blended drawstring described in the present invention exhibits 1% secant modulus values ranging from 3,000 to 8,000 pounds per square inch, compared to typical high density polyethylene drawstrings which have 1% secant modulus values ranging from 35,000 to 65,000 pounds per square inch. In the present invention, the closed loop elastic drawstring 18 is formed to have a circumference which is smaller than the circumference of the top opening of the plastic bag 10. Further, the closed loop elastic drawstring 18 is formed from elastic material in its relaxed state. As such, the closed loop elastic drawstring 18 does not close the opening in the top of bag 10 to a circumference smaller than that at which the opening is formed either as the closed loop drawstring 18 is formed or after its release from a receptacle over which the bag is placed. In actual practice, the closed loop elastic drawstring 18 may not even retract completely to its own original circumference upon release from a container, depending upon the degree to which it was stretched to fit over the receptacle.

The formation of the closed loop elastic drawstring 18 is achieved by providing notches 22 at each end of the hems 16 so that the ends of individual drawstrings are exposed at each end of the hems 16. The exposed ends of the drawstrings are then sealed at 24 in close proximity to the ends of the hems. A closed loop elastic drawstring 18 is thus provided by the elastic drawstrings between the seals 24. Since the seals 24 are located inside of the edges 15 the circumference of the bag 10 is greater than the circumference of the drawstring 18 as the bag is formed. Thus, the liner bag 10 can be fabricated without stretching the closed loop elastic drawstring 18. This is important in reducing production costs as well as in the ability to fold or roll the bag without any special handling, as well as providing a safety feature for a child who may inadvertently place the bag over his head.

The plastic bag 10 can be formed on a bag making line such as an Amplas Sideweld Drawstring Bag Machine made by Amplas, Inc. of Green Bay, Wi. In a machine of this type, the film or sheet of thermoplastic material is shown passing through the hem forming section of the machine where the hems are turned under the film as shown in FIG. 4. The drawstring is then slit from a two inch tape into two one inch strips. These strips are placed near the hems but not completely inside the hems, as shown in FIG. 5. This is done so the notching operation is not interfered with by the drawstrings. The web then passes through a folding section to fold the bag in half, as shown in FIG. 6. Up to this point the web is in continuous motion. Next, the web passes through a web drive and dancer system to convert the web's motion to intermittent. The notches are then cut from the hems, as shown in FIG. 7. FIG. 8 shows the web after the drawstrings have been guided into the hems and sealed in area 24 in close proximity to the inner edges of the notches near the hems. Next, the hems are sealed as the film passes through a longitudinal hem sealer, as shown in FIG. 9. The side edges and ends of the drawstrings are sealed and cut simultaneously to form the bag in the final step, as shown in FIG. 10. It should be noted that this process is continuous and intermittent, but does not interfere with the normal speed of the machine. After the bag is formed it is passed to a folding machine for folding and packaging.

Thus, it should be apparent that there has been provided in accordance with the present invention a plastic liner bag with elastic top and tie strip that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A generally rectangular plastic liner bag for a receptacle, said bag comprising:

a plastic sheet folded to form a closed bottom and sealed along each edge to define an open top having a predetermined circumference;

a hem provided on each side at the top of said bag;

a notch provided at each end of the said hems, and an elastic drawstring provided in each hem with the ends of said drawstrings being joined together in the notches at each end of the hems to form a closed loop elastic drawstring whereby said closed loop elastic drawstring has a circumference less than the circumference of the top of said bag as said bag is formed and whereby said closed loop elastic drawstring has sufficient elasticity to expand to conform to the top of the receptacle when placed over the receptacle and to retract to a circumference less than that of the receptacle when removed from the receptacle but does not retract to a degree to close the top of said bag beyond said predetermined circumference.

2. The bag of claim 1 wherein said drawstrings are formed from a thermoplastic rubber.

3. The bag of claim 1 wherein said drawstrings are formed from an elastomeric polyolefin.

4. The bag of claim 1 wherein said drawstrings are formed from a thermoplastic rubber-linear low density polyethylene blend.

5. The bag of claim 4 wherein said blend is 50% thermoplastic rubber, 40% linear low density polyethylene and 3% pigment.

* * * * *